US011578848B2

(12) United States Patent
Biasotti

(10) Patent No.: US 11,578,848 B2
(45) Date of Patent: Feb. 14, 2023

(54) SIMULATED TORCH NOVELTY DEVICE

(71) Applicant: Mark Andrew Biasotti, San Jose, CA (US)

(72) Inventor: Mark Andrew Biasotti, San Jose, CA (US)

(73) Assignee: Mark Andrew Biasotti, San Jose, CA (US)

( * ) Notice: Subject to any disclaimer, the term of this patent is extended or adjusted under 35 U.S.C. 154(b) by 0 days.

(21) Appl. No.: 17/542,375

(22) Filed: Dec. 4, 2021

(65) Prior Publication Data

US 2022/0178508 A1 Jun. 9, 2022

Related U.S. Application Data

(60) Provisional application No. 63/121,942, filed on Dec. 6, 2020.

(51) Int. Cl.

| | |
|---|---|
| ***F21S 10/04*** | (2006.01) |
| ***F21S 6/00*** | (2006.01) |
| ***F21V 23/06*** | (2006.01) |
| ***F21V 23/00*** | (2015.01) |
| ***F21Y 115/10*** | (2016.01) |

(52) U.S. Cl.
CPC ..... *F21S 10/04* (2013.01); *F21S 6/001* (2013.01); *F21V 23/003* (2013.01); *F21V 23/06* (2013.01); *F21Y 2115/10* (2016.08)

(58) Field of Classification Search
CPC ..... F21S 10/04; F21S 6/001; F21V 23/003; F21V 23/06
USPC ..... 362/569
See application file for complete search history.

(56) References Cited

U.S. PATENT DOCUMENTS

| | | | | |
|---|---|---|---|---|
| 4,965,707 | A | 10/1990 | Butterfield | |
| 6,691,440 | B1 | 2/2004 | Petz | |
| 6,799,727 | B2 | 10/2004 | Webster | |
| 7,111,421 | B2 | 9/2006 | Corry | |
| 7,162,820 | B2 | 1/2007 | Hess | |
| 7,305,783 | B2 | 12/2007 | Mix | |
| 7,322,136 | B2 | 1/2008 | Chen | |
| 9,810,388 | B1 * | 11/2017 | Li | F21V 5/048 |
| 10,184,625 | B1 | 1/2019 | Lauer | |
| 11,092,302 | B2 * | 8/2021 | Wu | A61M 11/06 |
| 2002/0152655 | A1 | 10/2002 | Merrill | |
| 2005/0169812 | A1 * | 8/2005 | Helf | A61L 9/127 422/123 |
| 2006/0034079 | A1 * | 2/2006 | Schnuckle | B44C 5/06 362/253 |
| 2006/0034100 | A1 * | 2/2006 | Schnuckle | F21V 13/14 362/362 |
| 2006/0115386 | A1 * | 6/2006 | Michaels | A61L 9/14 422/123 |
| 2006/0120080 | A1 * | 6/2006 | Sipinski | H05B 45/44 362/253 |
| 2013/0100686 | A1 * | 4/2013 | Patton | F21S 10/04 362/392 |

(Continued)

*Primary Examiner* — Bryon T Gyllstrom

(57) ABSTRACT

An indoor-outdoor novelty device which simulates moving open flame from the upper end of a standing torch. The device provides a realistic illusion of a bright flame changing its shape and brightness pseudorandomly thru a unique combination of lighting, motion, and airflow under microcontroller control. The device can be viewed from a vantage point in a 360-degree perimeter around the device without compromise to the effect.

11 Claims, 11 Drawing Sheets

(56) References Cited

U.S. PATENT DOCUMENTS

| | | | | |
|---|---|---|---|---|
| 2014/0254148 | A1* | 9/2014 | Fournier | F21V 23/003 362/235 |
| 2015/0338086 | A1* | 11/2015 | Patton | F21V 14/08 362/277 |
| 2016/0116127 | A1* | 4/2016 | Patton | F21S 10/046 362/284 |
| 2016/0312969 | A1* | 10/2016 | Patton | F21S 6/001 |
| 2017/0211767 | A1* | 7/2017 | Baeza | F21S 9/03 |
| 2019/0101264 | A1* | 4/2019 | Li | F21V 15/01 |

* cited by examiner

SIMULATED TORCH NOVELTY DEVICE

This application claims the benefit of provisional patent application No. 63/121,942 filed Dec. 6, 2020, and is incorporated by reference in its entirety herein.

SUMMARY OF INVENTION

This relates to novelty lighting, specifically the simulation of fuel-based flaming torches. This apparatus is placed indoors or outdoors and when powered by a standard landscape lighting power supply, simulates real flame protruding from the upper distal end of the torch.

BACKGROUND OF THE INVENTION

Lighted torches burning organic and fossil fuels have existed for a millennium as a way to light dark areas. In the $20^{th}$ and $21^{st}$ century however incandescent and light-emitting diode lamp technologies have replaced burning torches as the modern, more efficient light source. Burning torches, for the most part, are still popular today as a novelty attributable to an atmospheric and mood enhancement. With increasing global pressure to reduce our use of fossil fuels and thereby reduce carbon emissions, it is advantageous to find alternative solutions to nature light (open flame) while retaining its atmospheric and mood-enhancing attributes. Incandescent and LED lighting as aforementioned accomplishes this goal but does not provide the warmth, glow, and charm of open flame that we, as humans intrinsic longing for.

U.S. Pat. No. 10,184,625B1 (2019) to Lauer is an artificial candle that is comprised of a delicate glowing shroud or sock that can flutter like a candle flame, and the shroud surrounds a "wick" that can be seen through the shroud to glow. The shroud is actuated by a fan or air pump located in a central body of a chandelier. The wick is lighted by a light-emitting diode (LED).

U.S. Pat. No. 7,322,136B2 (2008) to Chen is an electric fireplace having a fire simulating assembly. The assembly includes a semitransparent light filter screen, a mirror glass wall, and a dynamic light source. The light source includes a fixed light source and aphotic cover composed of many rotating centrifugal blades. The centrifugal blades rotate around the center of the light source thereby causing light to reflect through the centrifugal blades. The device achieves a natural effect of vivid, rising, and leaping simulated flame.

U.S. Pat. No. 7,162,820B2 (2007) to Stinson and Hess is an assembly for providing an image of flames. The device has a light source, a screen, and a simulated interior fireplace wall positioned behind the screen. The screen has a front surface and is positioned in a path of light from the light source. The screen is adapted to transmit the image of flames through the front surface which is adapted to permit observation of part of the simulated interior fireplace wall.

U.S. Pat. No. 7,111,421B2 (2006) to Corry and Corrffy is a simulated log fireplace apparatus. A blower directs air onto the flame sheet to simulate real flame movement. A colored light source provides the color of real flames. The light source and blower are adjustable from a control panel under a top louver panel. The artificial log may include a translucent base log and an ember bed with a light source beneath the translucent log. A transparent partition has a partially opaque area just above the simulated flame sheet that provides the full depth of a real fireplace.

U.S. Pat. No. 6,799,727B2 (2004) to Webster and Stanley is a Flame-effect heating apparatus. Simulated fuel is supported by the housing and a flame-effect generator is located in the duct. A light source illuminates both the simulated fuel and the flame-effect generator. A mirror is mounted to the flame-effect generator. A wall of the housing provides a viewing screen on which light reflected by the mirror falls. An electric fan causes air to flow through the air duct, so causing the operation of the flame-effect generator.

U.S. Pat. No. 6,691,440B1 (2004) to Petz, Betz, and Lunscher is a device for artificially simulating a fire, in particular for use in the hearth of an open fireplace, having a housing in which, to simulate a fire, an artificial fuel bed into which moving, in particular strip-shaped, tongue-shaped or tab-shaped flame simulation elements whose image is reflected into the field of vision, and at least one light source for illuminating the fuel bed and/or the flame simulation elements are arranged, the flame simulation elements being arranged on at least one moving, motor-driven carrier element.

U.S. Pat. No. 4,965,707A (1990) to Butterfield is a device simulating flame effect means, such as suspended ribbons moved by a forced stream of air from a fan, receive light from a source which is then reflected onto a diffusing screen. The screen, which is both transparent and partially reflective, is situated in front of the means for simulating combusting fuel. The light reflected by the flame effect means, which gives the appearance of flames, thereby appears to emanate between the simulated fuel and its image reflected in the screen.

U.S. Pat. No. US20020152655A1 (2002) to Merrill and Lapointe is an apparatus which is comprised of a support member and an air source aimed at a flame strip that simulates real flames in such as a fireplace hearth.

U.S. Pat. No. 7,305,783B2s (2007) to Mix and Lyons is a lenticular fireplace and methods for simulating a fire within a fireplace. In one respect, a fire is simulated with a lenticular screen. The lenticular screen includes a lenticular lens layer and an image layer, wherein the image layer comprises one or more images of fire. A device is coupled to the lenticular screen that moves the lenticular screen to alter a viewed image of the fire. The apparatus is used in a front wall of an enclosure.

SUMMARY OF THE INVENTION

The present invention generally discloses a device which simulates flames emanating from the upper distal end of a torch in much the same way that a wick soaked in fuel burns from the upper end of a real torch. The simulated flame effect is achieved by a diffuser lit from underneath by an array of LEDs located at the enclosure's base, thereby reflecting light on a flexible filament. At the base of the enclosure, a blower draws air up and across both vertical sides of the filament resulting in a fluttering motion of the filament. As light is reflected on the filament and the resultant effect is light traveling in a fluid pattern upward till it disappears. Additionally, the filament is mounted on a pivot that accentuates the flutter effect by allowing the filament to freely oscillate back and forth on the pivot with air pressure changes. Furthermore, the entire filament's rotation and velocity are pseudorandom and result in a seemingly ever-changing flame profile from the observer's point of view. The blower's air velocity and the LED's brightness are pseudorandomly changing, furthering the pseudorandomness found in nature. The armature's rotation, blower velocity, and LED array circuit brightness are controlled by a microcontroller.

ADVANTAGES

Several advantages of the present disclosure are: the device simulates real open flame without the use of an actual flammable fuel source. The simulated flame effect can be viewed at any position 360 degrees surrounding the device with equal effect. There is no need for fuel since the device is powered by low voltage electricity. The device is low power and therefore safe to be operated outdoors. An additional advantage is that the device can be powered by a standard 12 VAC landscape lighting circuit that controls its illumination when the landscape lighting circuit is enabled. Because it is not an actual flame that can combust other objects nearby, it can be placed anywhere outdoors as well as indoors. It is virtually silent (below 40 db). Operating the device results in a lower carbon footprint since it does not require fossil fuel nor does it emit pollutants.

REFERENCE NUMERICS

Figure 1:
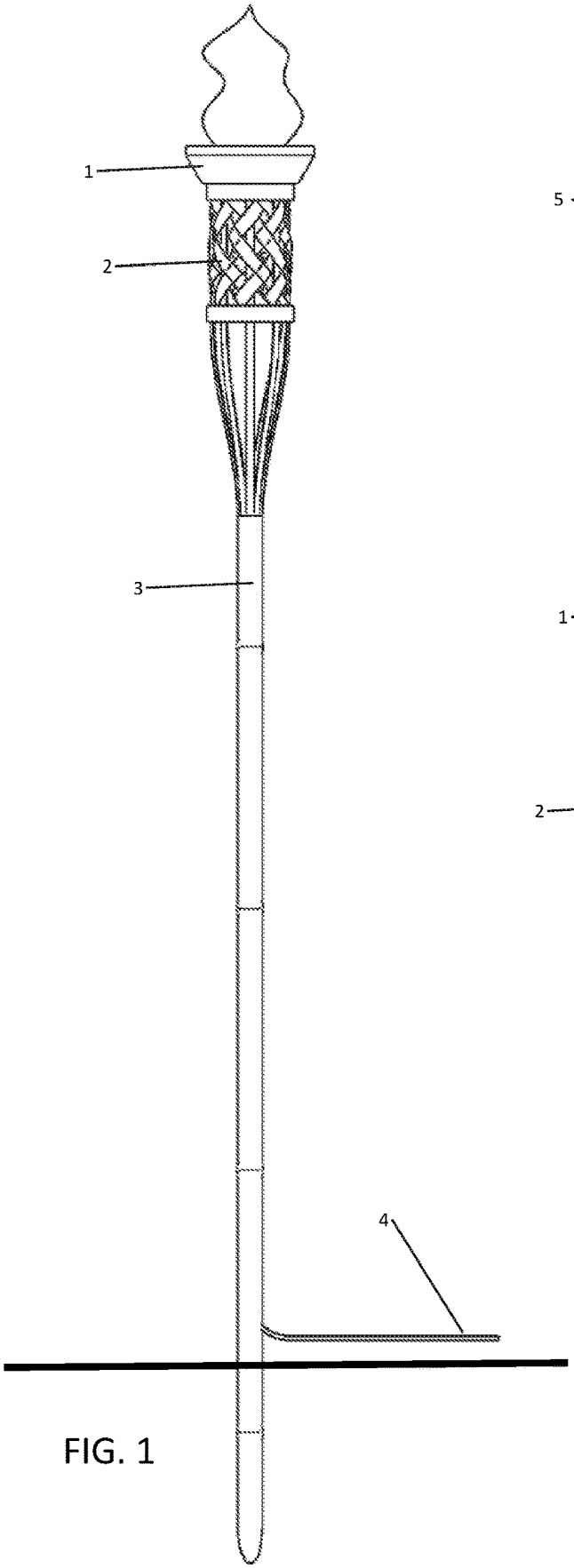
FIG. 1 illustrates a front view as observed from the viewer standing at eye-level while observing the device.

1. Mechanism enclosure
2. Wicker wrap housing
3. Pole
4. Power cord
5. Filament
6. Filament pivot
7. Armature
8. Dual armature
9. Triple armature
10. Gear motor
11. Diffuser
12. LED Array circuit
13. Microcontroller
14. Printed circuit board
15. Blower motor
16. Blower blade
17. Filament reflection
18. Bridge rectifier
19. 5V regulator
20. DRV8871 motor driver
21. 0.39 ufd electrolytic capacitor
22. 47 ufd electrolytic capacitor
23. 0.1 ufd capacitor
24. 0.1 ufd capacitor
25. N-Channel MOSFET
26. N-Channel MOSFET
27. 10 ohm ½ W resistor
28. 10K ohm ⅛W resistor
29. 10K ohm ⅛ W resistor
30. 120 ohm ⅛ W resistor
31. 120 ohm ⅛ W resistor
32. Passive armature
33. Armature fan blade
34. Governor gear
35. Idler gear
36. Governor gear pin
37. Idler gear pin
38. Governor bushing

DETAILED DESCRIPTION

FIG. 1 is a frontal view, as observed from approximately 12 feet away, of the device constructed in accordance with the one embodiment. A pole 3 is affixed to the ground. A mechanism enclosure 1 is located at the upper distal end of the pole 3. A cosmetic wicker wrap housing 2 is affixed to the pole 3 and attached to the mechanism enclosure 1. A Filament 5 protrudes from the top side interior of the mechanism enclosure 1.

Figure 2:
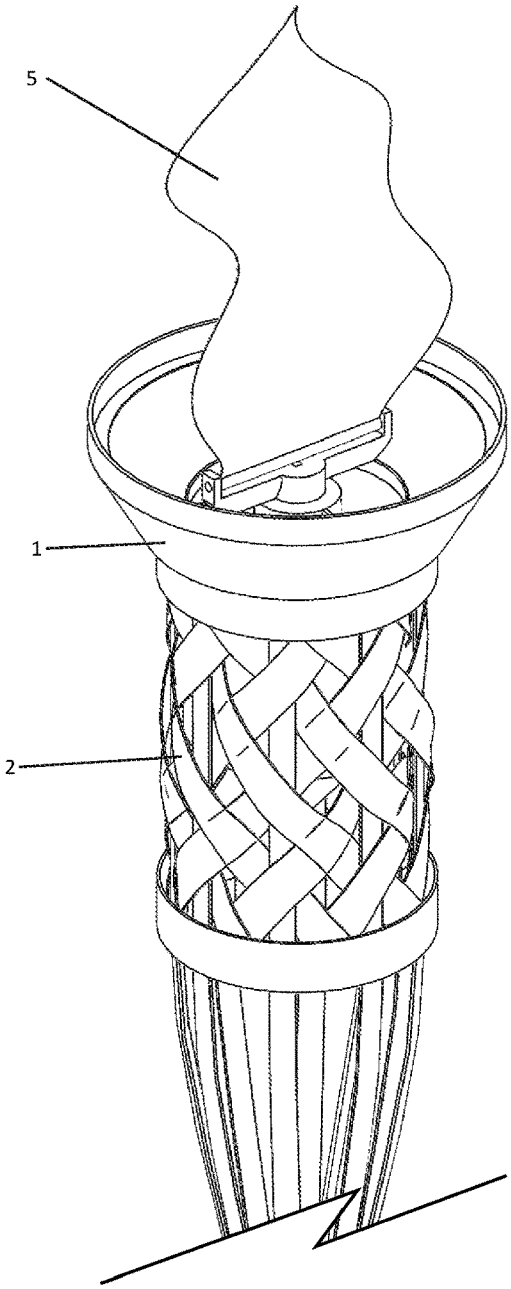
FIG. 2 illustrates a close-up, partial perspective view of the distal end of the device.

FIG. 2 is an alternate view of the device showing a perspective view looking down from the top and closeup view of the mechanism enclosure 1 and a portion of the wicker wrap 2. The filament 5 protrudes from the top opening of the mechanism enclosure 1.

Figure 3:
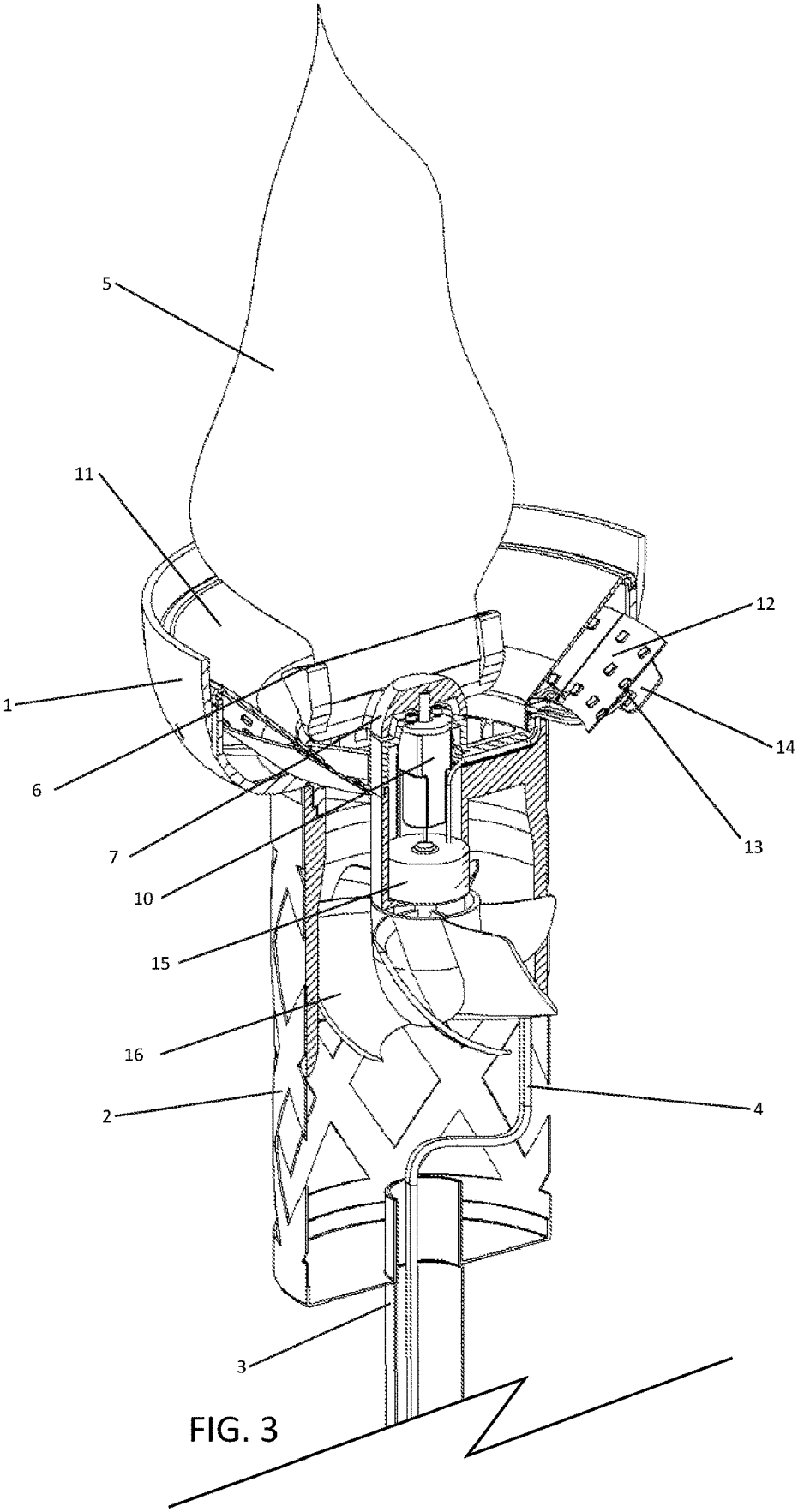
FIG. 3 illustrates a close-up, section view of the mechanism enclosure showing the device's internal components.

FIG. 3 shows a partial section view through the mechanism enclosure 1 and wicker wrap 2. The filament 5 is attached to an armature 7 and the filament 5 pivots 6 on an armature 7 allowing the filament 5 to pivot forward and backward as a result of airflow emanating from a blower blade 16. The armature 7, with the affixed filament 5 is attached to a gear motor 10 and rotates and reverses the rotation of the armature 7 360 degrees with pseudorandom velocity and rotation direction. Light is reflected onto the filament 5 from a diffuser 11. The diffuser 11 is illuminated from below by a LED Array Circuit 12 (a series of individual LEDs) 12. A Microcontroller 13 is affixed to the printed circuit board 14. A blower motor 15 is affixed to the mechanism enclosure 1. A blower blade 16 is attached to and rotated by the blower motor 15.

Figure 4A:
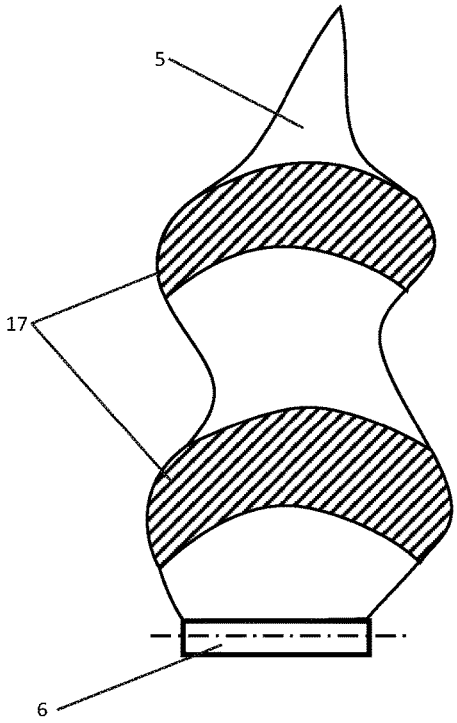
FIGS. 4A, 4B, 4C, and 4D illustrate the filament and filament pivot as observed from the front and side views.
Figure 4B:
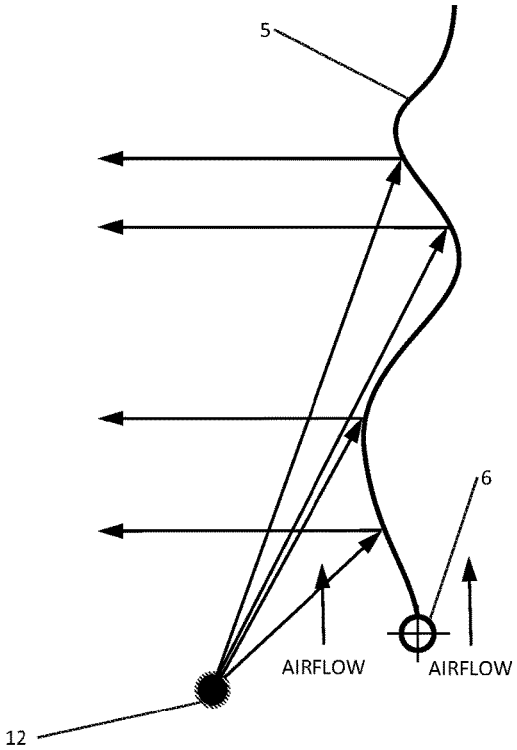
Figure 4C:
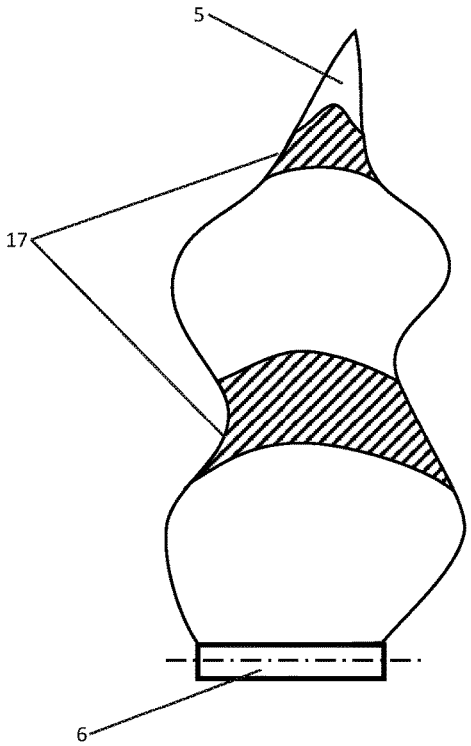
Figure 4D:
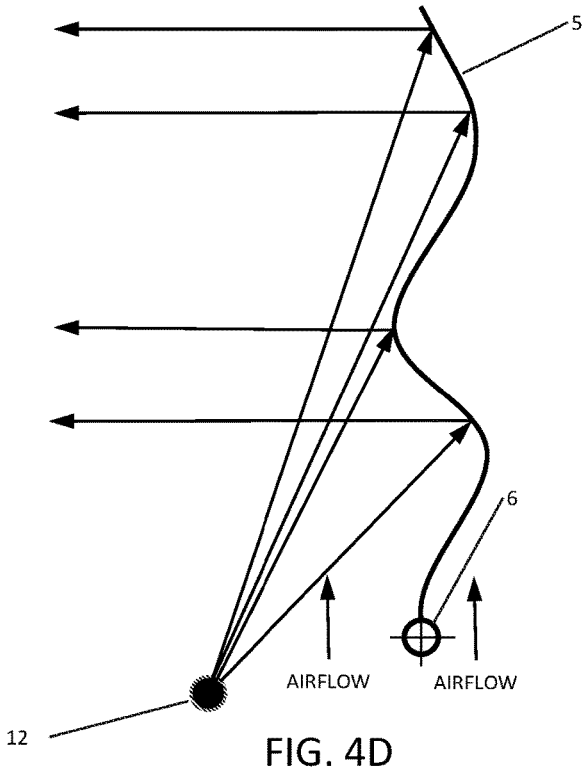

FIGS. 4A and 4B respectively, show a front view and side view of the filament 5. The hatched areas in FIG. 4A represent light filament reflection 17 emanating from the LED Array Circuit 12 below. Airflow across the front and rear of the filament 5 animate the shape of the filament reflection 17 from the observer's point of view as illustrated by the difference of filament reflection 17 of FIG. 4A versus FIG. 4C.

Figure 5A:
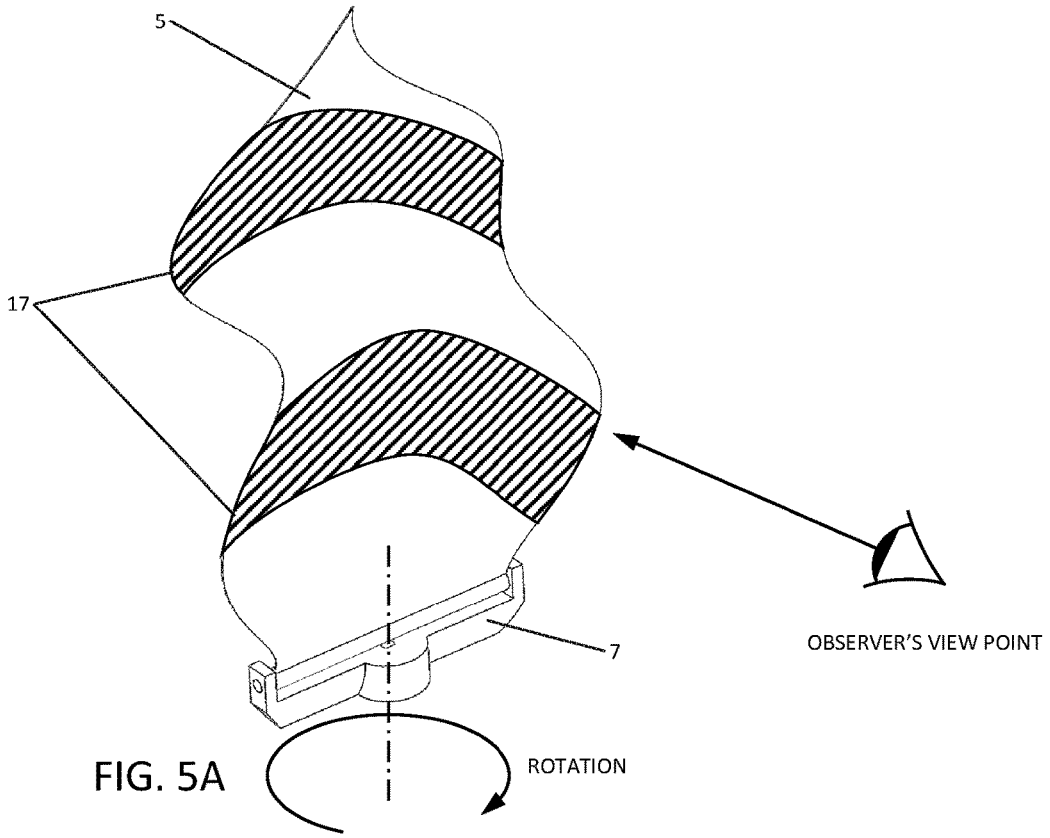
FIG. 5A illustrates a perspective view of the filament and armature.
Figure 5B:
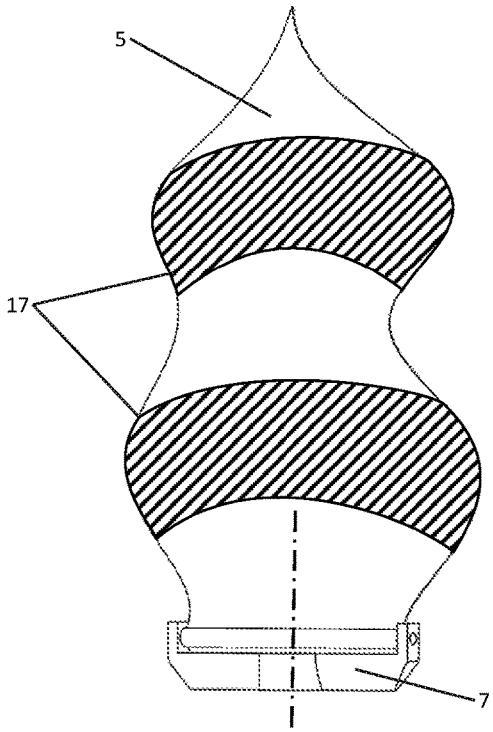
FIGS. 5B, 5C, and 5D illustrate the observer's perspective of the filament standing stationary at eye level when the armature is rotated at various degrees.
Figure 5C:
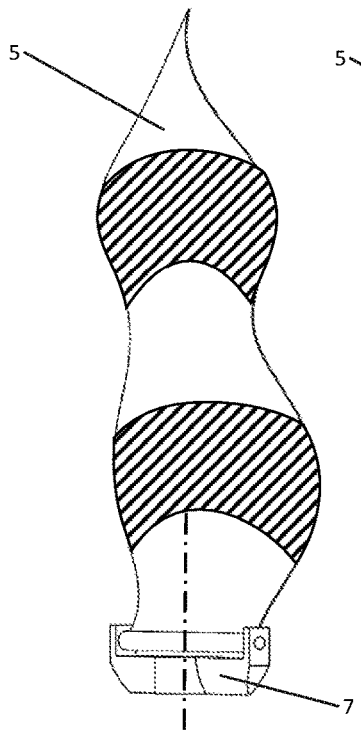
Figure 5D:
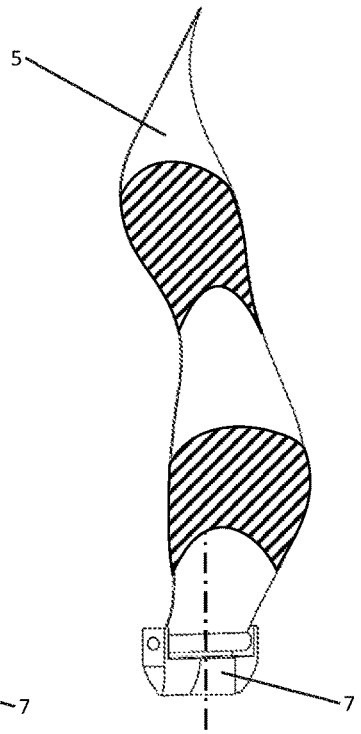

FIG. 5A shows a perspective view of the filament 5 and the armature 7. The filament is comprised of a transparent or semitransparent flexible material. From the observer's point of view, light emanates from portions of the filament 5 as indicated by the filament reflection 17 hatched areas. FIGS. 5B, 5C, and 5D show the filament 5 rotated by the armature 7 by various degrees from the observer's view. From the observer's view, the filament reflection 17 changes shape depending on the degree of rotation of the armature 7. This in combination of the filament's 5 rotation on it's armature 7 and the shape as altered by the air blown across the filament 5 (FIG. 4A, 4C) contributes to a multitude of different filament reflections 17 when observed from a stationary point of view.

Figure 6:
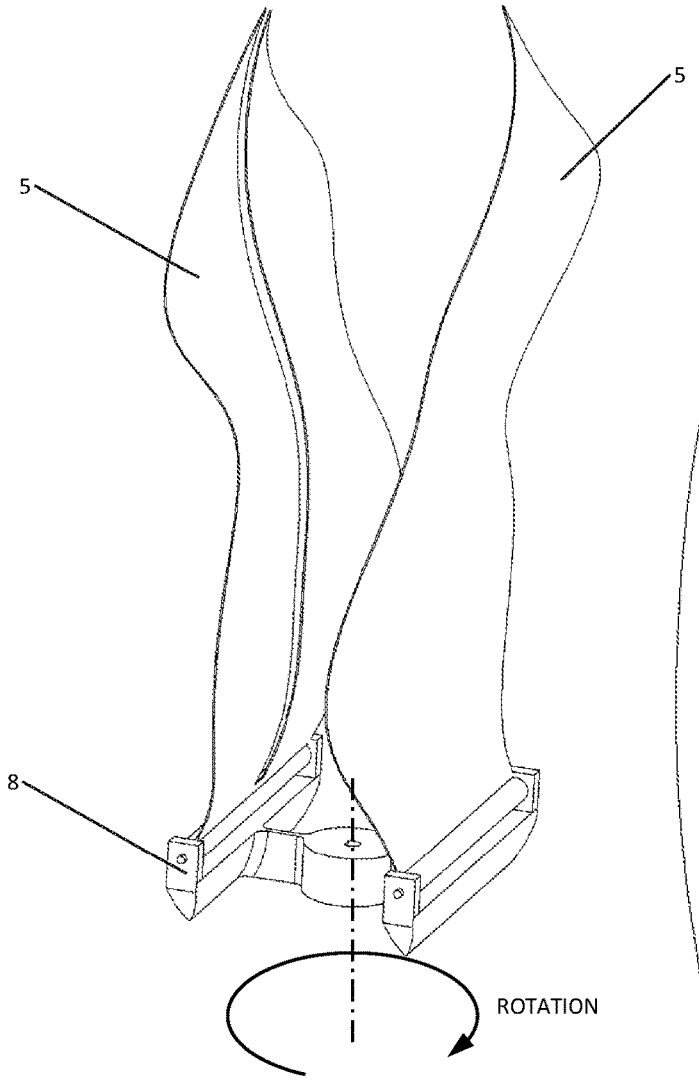
FIG. 6 shows a dual armature assembly with multiple filaments.

FIG. 6 shows an alternative embodiment of a dual armature 8 which consists of two support members and multiple filaments 5 attached.

Figure 7:
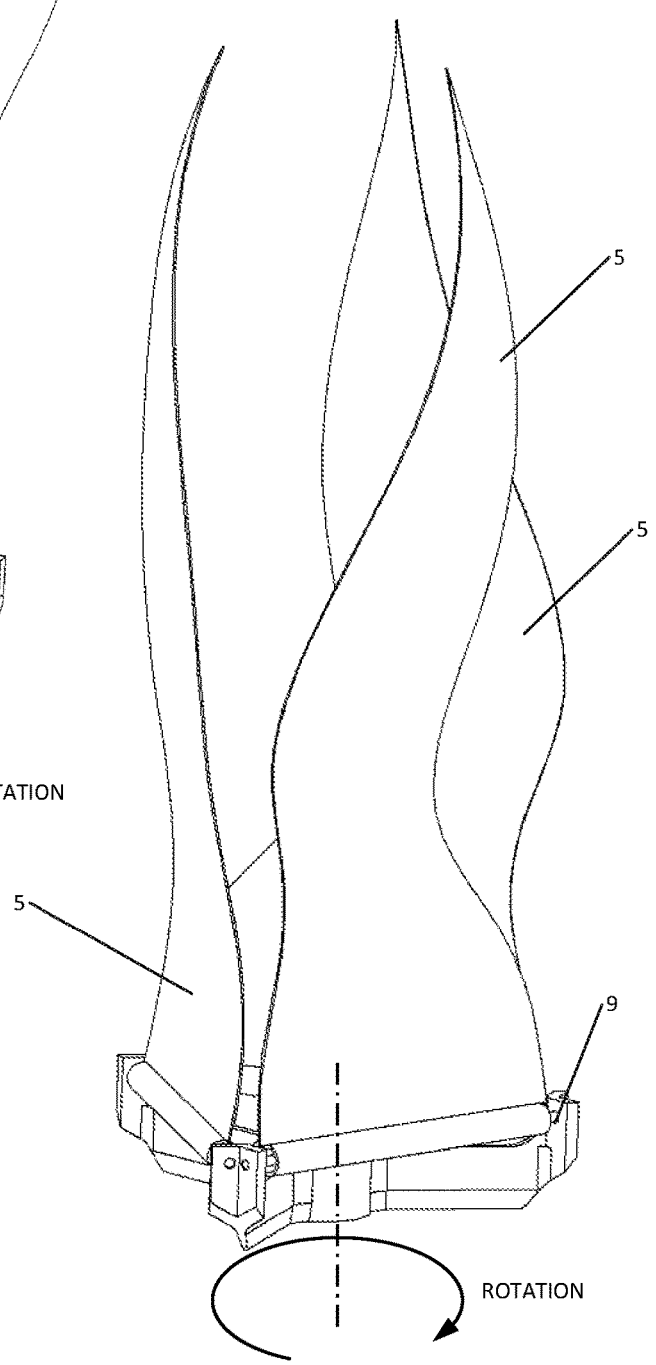
FIG. 7 shows a triple armature assembly with multiple filaments.

FIG. 7 shows an alternative embodiment of a triple armature 9 which consists of three support members and multiple filaments 5 attached.

Figure 8:
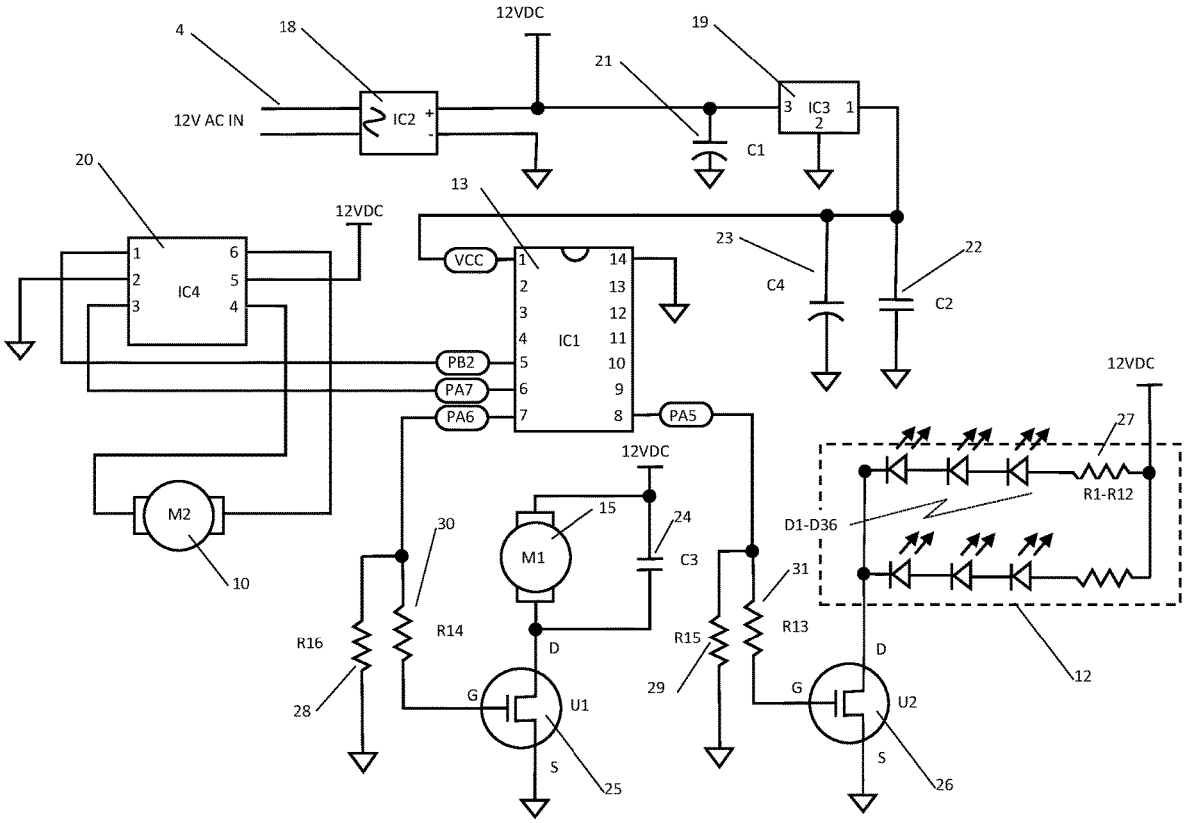
FIG. 8 shows an embodiment of a schematic view of the electronic circuit of the device.

FIG. 8 shows a electrical schematic of the device's printed circuit board 14. The main parts of the schematic are as follows: M2 10 is a 12 VDC gearmotor, such as 2368 made by Pololu Corporation; IC1 13 is a microcontroller, such as an ATTINY84 made by Microchip Corporation; M1 15 is a 12 VDC brushless motor, such as B078MSFFH5 made by EUDAX; IC2 18 is a bridge rectifier, such as a KSLDB340S made by Rectron USA; IC3 19 is a 5V fixed voltage regulator, such as a NX1117CE50Z made by Rochester Electronics, LLC.; IC4 20 is a unipolar motor driver, such as DRV8871DDAR made by Texas Instruments; C1 21 is a 0.39 ufd electrolytic capacitor, such as a C1206C394K3RACTU made by KEMET; C2 22 and C43 24 are a 0.1 ufd ceramic capacitor, such as a made by Samsung; C4 23 is a 47 ufd electrolytic capacitor, such as a T58W0476M8R2C0500 made by Vishay; U1 25, and U2 26 are N-channel MOSFETs, such as a IRLL110TRPBF made by Vishay Siliconix; R1-R12 27 are 12 ea. 10 ohm ½ W resistor, such as RNCP1206FTD10R0 made by Stackpole Electronics; R16 28, and R15 29 are 10K ohm ⅛ W 1M resistors, such as CRCW080510K0FKEAC made by Vishay; R14 30, and R13 31 are 120 ohm ⅛ W resistors, such as CRCW0805120RFKEAC made by Vishay;

Again referring to FIG. 8 the device is connected to a power cord 4 (refer to FIG. 1) and the power cord 4 is connected to a standard 12 VAC supply such as used by a low-voltage landscape lighting system. IC2 18 converts the incoming 12 volts AC to 12 volts DC. C1 21 serves as a line filter capacitor for the 12V DC coming in. IC3 19 regulates the 12V DC to an output of 5V DC to provide a suitable power supply for IC2 13. C2 22 and C4 23 serve as a line filter for the 5V DC supply rail. Pin 8 of IC1 13 serves as a pulse-width-modulated output for the LED array circuit 12. Pin 8 output sends a pulse-width-modulated signal to voltage divider made up of R15 29 and R13 31. The resultant voltage from the voltage divider feeds the gate of U2 26 thereby energizing the drain of U2 26 and powering and varying the brightness of the LED array circuit 12 pseudorandomly. Output pin 7 of IC1 13 powers the blower M1 15. The pulse-width-modulated output of pin 7 sends a signal to the voltage divider circuit made up of R16 28 and R14 30. The resultant voltage from the voltage divider feeds the gate of U1 25 thereby energizes the drain of U1 25 to power M1 blower motor 15 and rotate attached blower blade 16 (refer to FIG. 3) and thereby varying air flow velocity pseudorandomly. C3 capacitor 24 serves as a bypass filter to reduce radio frequency noise from the M1 blower motor 15. Pin 5 and Pin 6 of IC1 13 send a pulse-width-moduled signal and direction (by way of logic) to IC4 20 to power the M2 gear motor 10. IC4 20 is a Bipolar MOSFET Driver IC which can control the speed and reverse the direction of M2 gear motor 10. A pulse-width-modulated output of pin 5 sends a signal to IC4 20 along with a LOW signal from pin 6 results in a clockwise rotation of M2 10 at a determined speed. Consequently, A pulse-width-modulated output of pin 6 sends a signal to IC4 20 along with a LOW signal from pin 5 results in a counter-clockwise rotation. Depending on the HIGH or LOW state of pin 5 and 6 and the pulse-width-modulated signal, the armature 7 (refer to FIG. 3) rotates clockwise or counter-clockwise at a prescribed velocity pseudorandomly.

Figure 9:
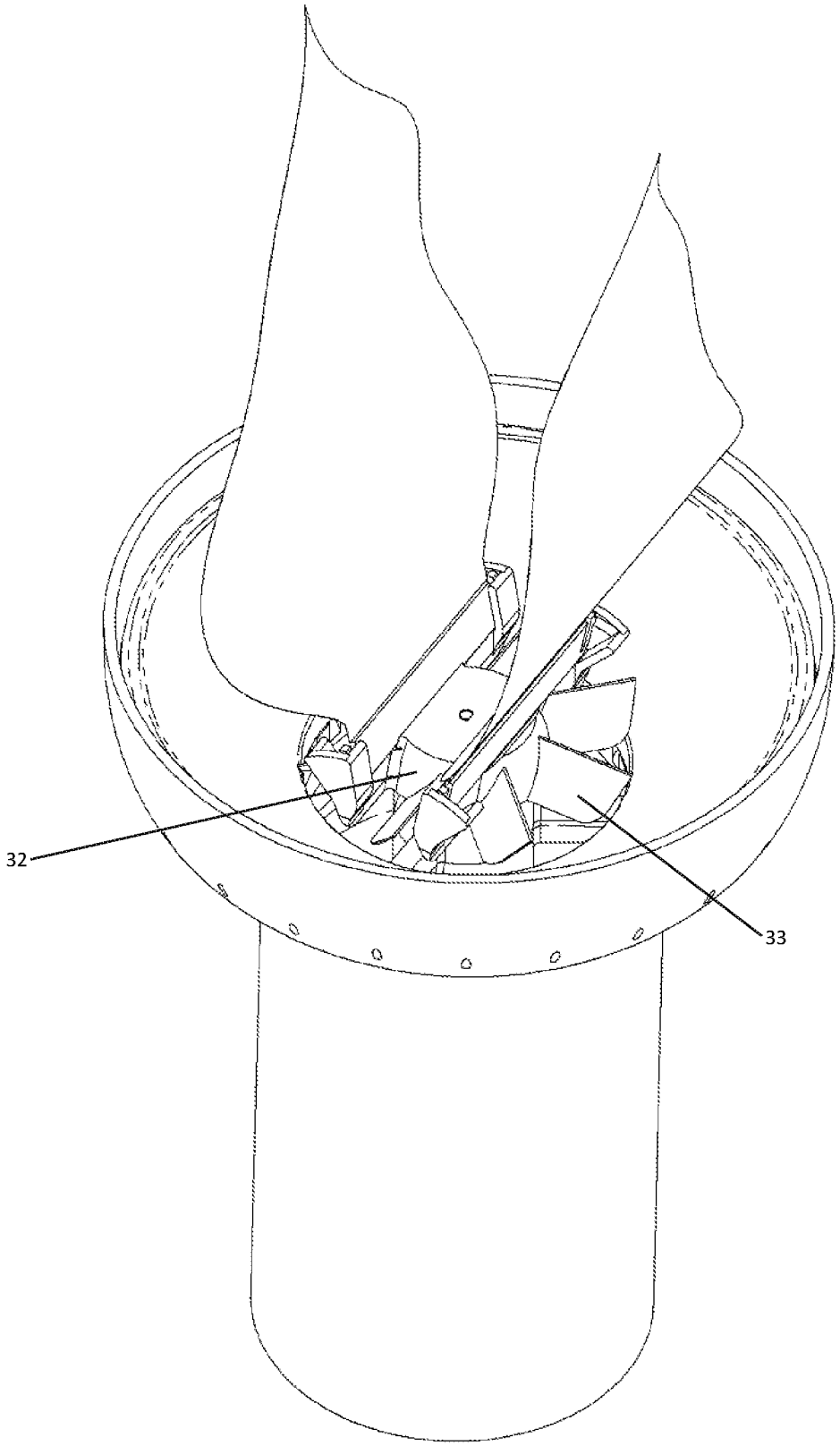
FIG. 9 shows the an alternative embodiment of the device with integrated fan blades as part of a passive armature.

FIG. 9 shows an alternative embodiment of the device with a passive armature 32 with integral fan blades 33 which facilitates the rotation of the armature thereby eliminating the need for a gear motor.

Figure 10:
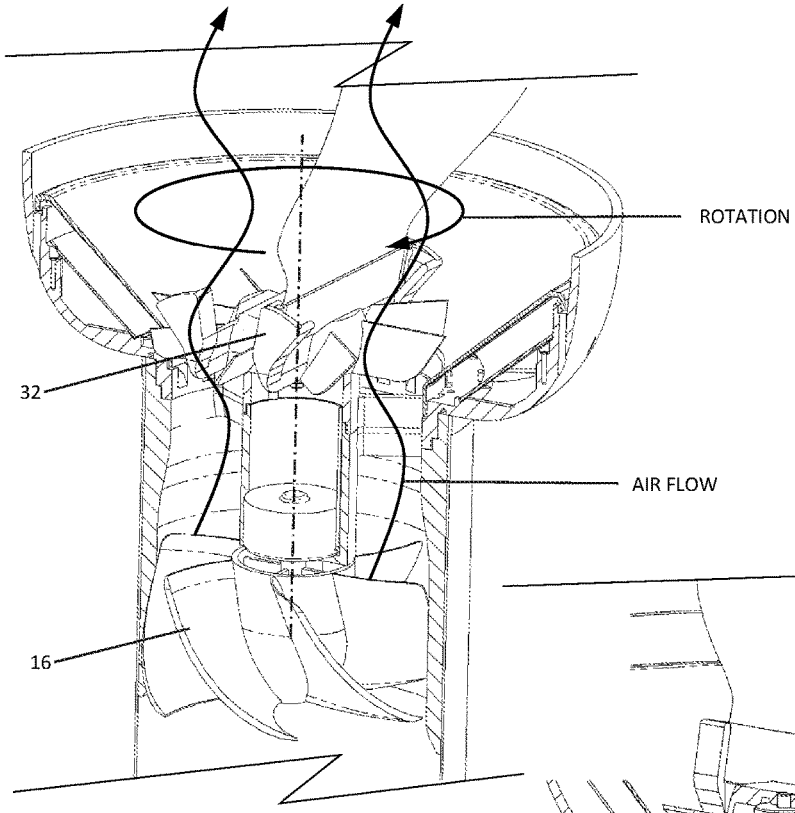
FIG. 10 shows an alternative embodiment of armature with integrated fan blades which replaces gear motor and facilitate rotation of the armature by way of airflow from the blower blade.

FIG. 10 shows a partial cutaway cross-section view of the device. Air flowing up from blower blade 16 facilitates the rotation of the passive armature 32.

Figure 11:
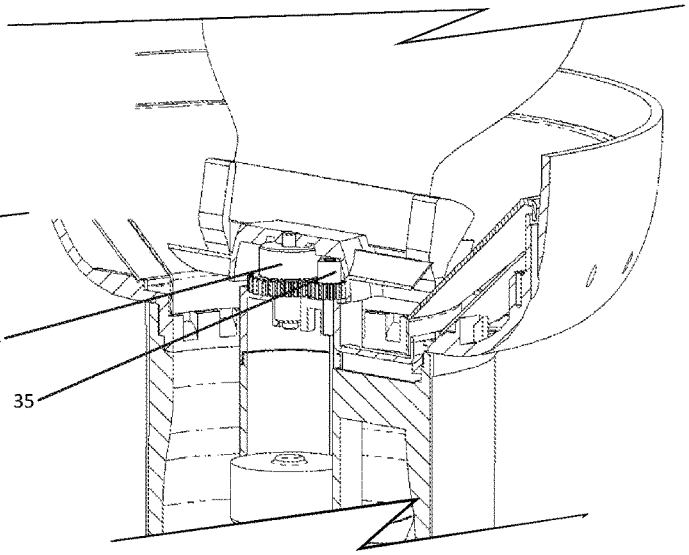
FIG. 11 shows a section view of a governor gear attached to armature and idler gear which regulates the speed of armature.

FIG. 11 shows a close-up partial view showing a cross-section of the device. A governor gear 34 is affixed to the passive armature 32. An idler gear 35 is positioned next to the governor gear 34.

Figure 12:
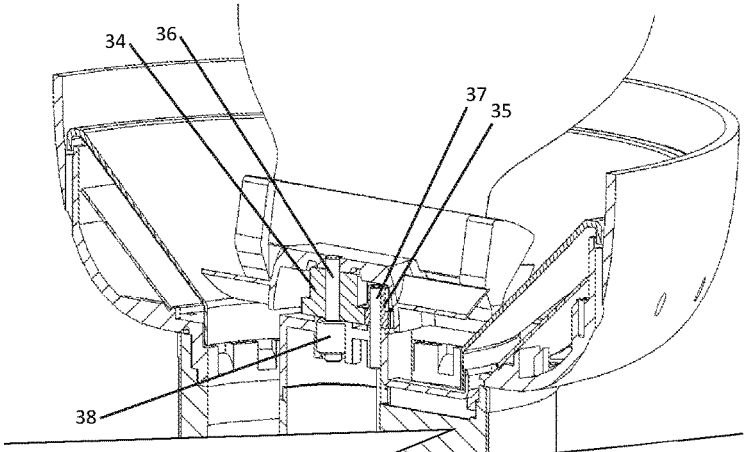
FIG. 12 shows a section view of governor gear and idler gear in relation to the passive armature.

FIG. 12 shows a partial cross-section view of the device and passive armature 32. The governor gear 34 is affixed to the governor gear pin 36. The idler gear 35 rotates freely on the idler gear pin 37. The governor bushing 38 provides a low friction pivot for the governor gear pin 36. The gear ratio between the governor gear 34 and the idler gear 35 provides a constant rate of velocity at which the armature rotates thereby regulating its speed of rotation.

Figure 13:
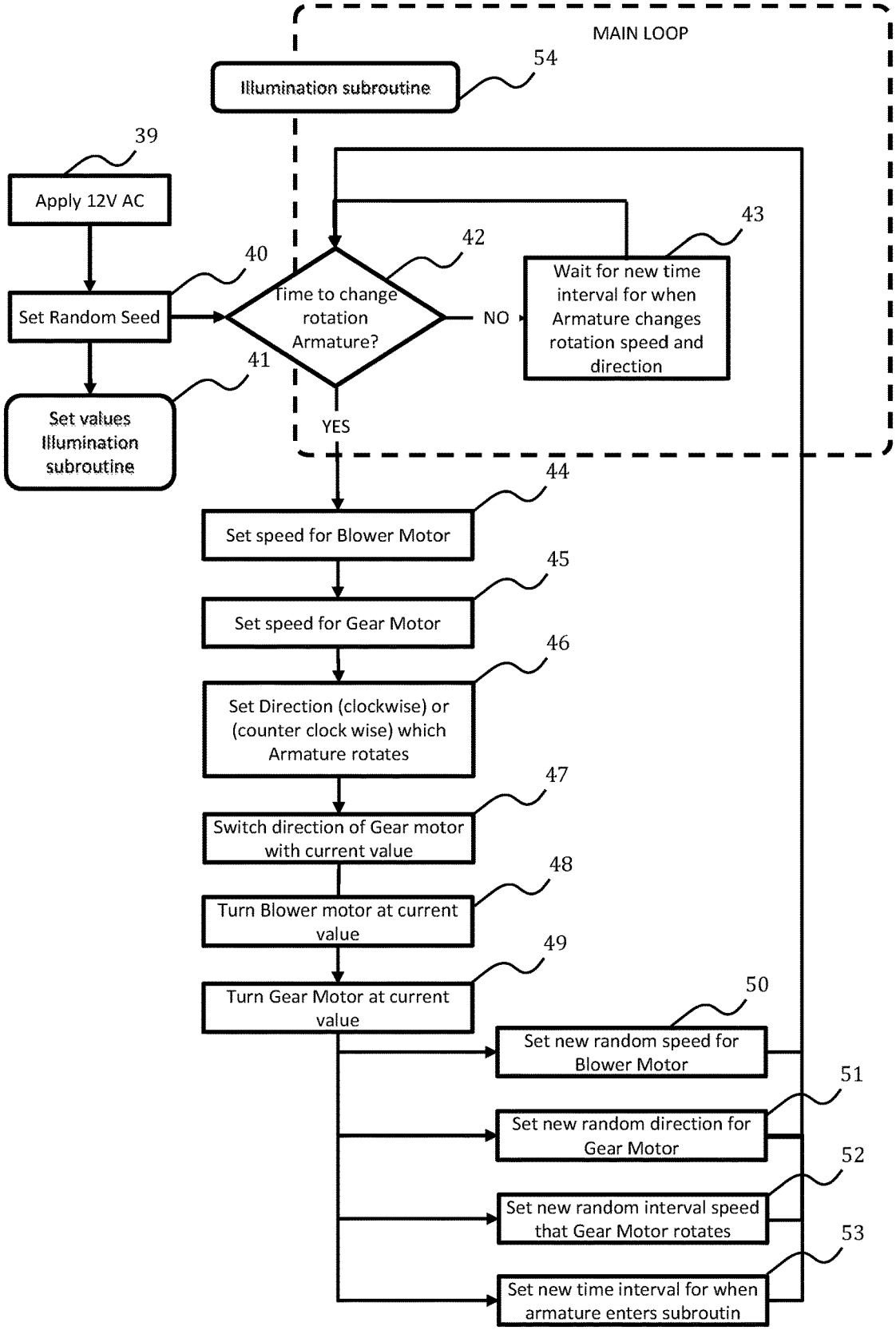
FIG. 13 shows a flow diagram for the program operation of the device.

FIG. 13 shows a main flow diagram of a program. When 12 VAC 39 is applied to the device, the program sets a random seed 40 for any random calls in the program. This maintains that each device (when several are used) that their armature's 7 speed and direction as well as blower motor 15 velocity and LED array circuit 12 illumination timing will be unique from one device to another. Also when 12 VAC is applied 39 the LED array circuit 12 is constantly lit by the Illumination subroutine 41. The program constantly determines 42 in the loop whether it is time to enter a subroutine to change the armature 7 speed and direction of rotation as well as the blower motor 15 speed. If the time interval is not reached, the program waits for 43 in the loop until the interval is reached. When the interval time is reached the program enters a subroutine which sets the current blower motor speed value 44, current gear motor speed value 45 and sets the value for the direction of the rotation of the gear motor 46 (clockwise or counterclockwise). At this point, the program changes the gear motor's direction to its current value 47, the blower motor speed to its current value 48 and gear motor speed to its current value 49. At this point the subroutine assigns a new random value for the speed of the blower motor 50, new random value for the direction of the gear motor 51, a new random value for the speed the gear motor rotates, and a new time value for the interval for when reentering the subroutine 53. Along with when to change the rotation of armature 42, the illumination subroutine (FIG. 14) 54 and the LED fade subroutine 60 are being executed continuously in the program loop.

Figure 14:
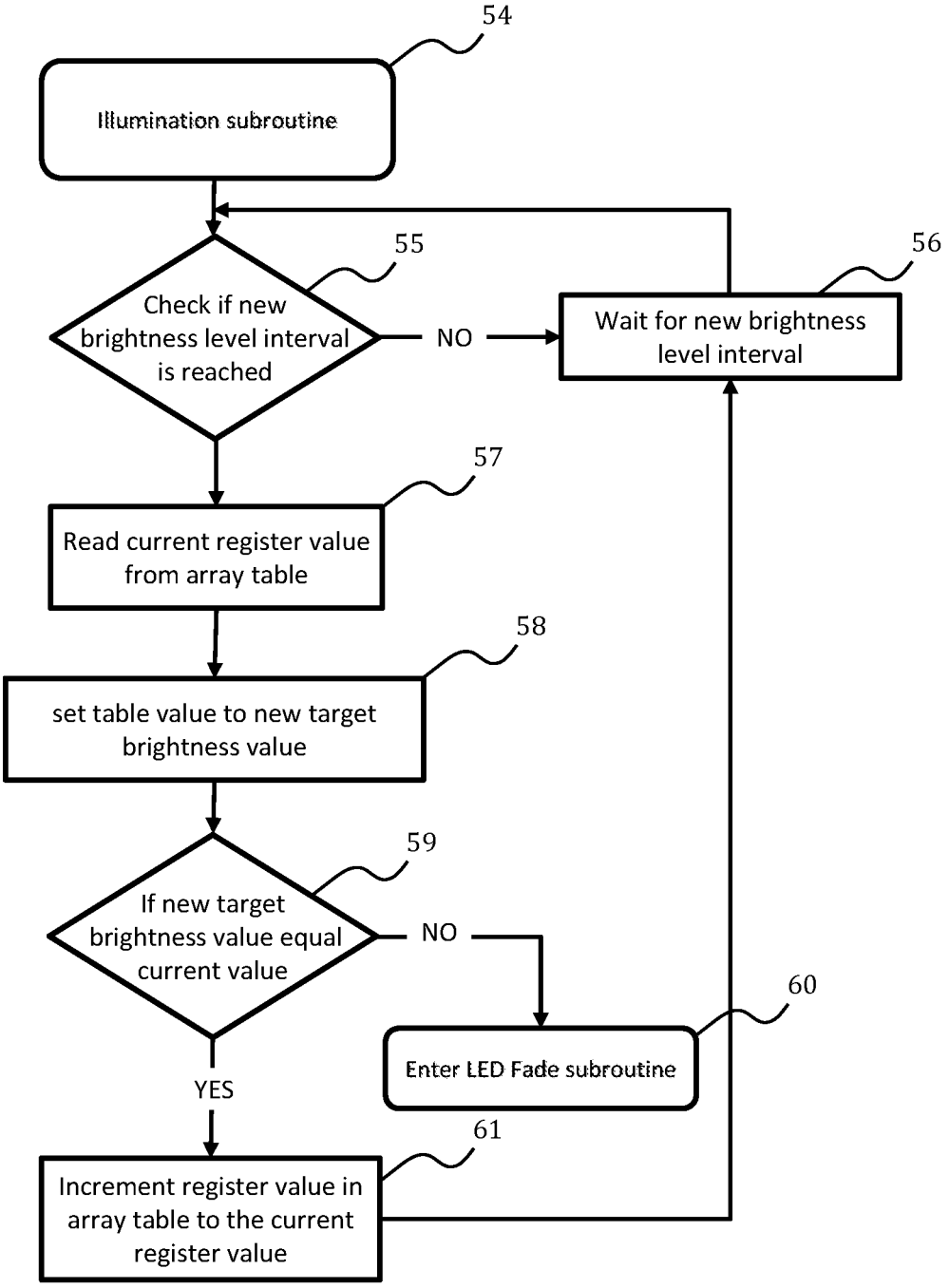
FIG. 14 shows a flow diagram for the illumination subroutine of the device.

FIG. 14 shows a flow diagram of the Illumination subroutine 54. Upon entering the subroutine, the program decided whether a new time interval for changing the brightness level has been reached. If NO then the program waits till the new interval has been met 56. If YES, the current register value in a pre-determined table array of values is read 57. The program sets the new array value to the new target brightness value 58. The program then decided whether that new target value equals the current brightness value. If NO, then the program enters LED fade subroutine (FIG. 15) 60. If YES, then the register in the array table is incremented to the next sequential value.

Figure 15:
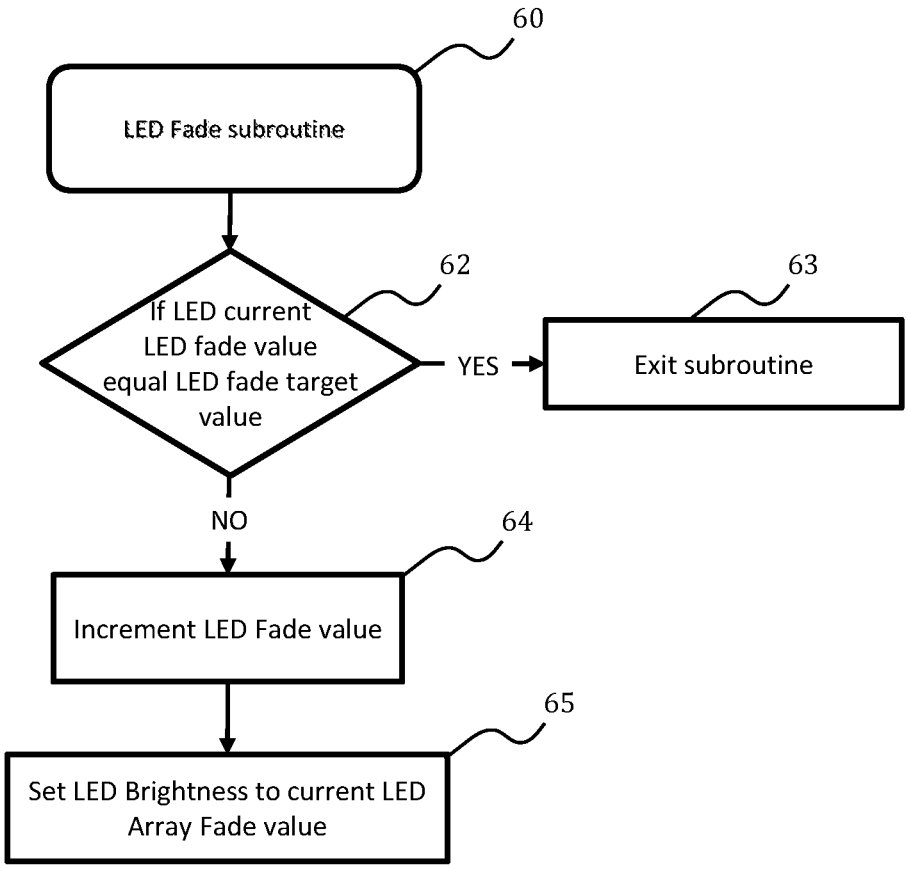
FIG. 15 shows a flow diagram for the LED fade subroutine of the device.

FIG. 15 shows a flow diagram of the LED fade subroutine 60. Upon entering the subroutine, the program decided whether the current LED fade value has been met 62. If YES, the subroutine is exited and returns to the main loop of FIG. 14. If NO, then the LED fade value is incremented 64, and LED array circuit 12 is set to the current fade value 65. At this point, the subroutine is exited and returns to the main loop of FIG. 14.

EXAMPLE OPERATION

In operational use, the user installs the device indoors or outdoors by affixing the lower end of pole 3 to the ground in the area where they desire it to be displayed in an upright position. The user then proceeds to connect the device's power cord 4 to their existing 12 VAC landscape lighting circuit, or other suitable power supply, by splicing into the existing landscape lighting circuit line using standard wire splicing nuts. When the landscape lighting circuit is energized, the device emits a bright yellow-orange simulated flame from the upper distal end of the device. From the observer's point of view, the flame (transparent filament) shape continually changes in shape and illumination in a flowing motion upward. This effect can be seen from any angle to the device and is not compromised in its effect from any vantage. The device is water-resistant and can be operated outdoors.

As will be apparent to those skilled in the art, there are other circuits and structures beyond and/or in addition to those explicitly described herein which will serve to implement the mechanism of the present invention. Although the above description enables the embodiments described herein, these specifics are not intended to restrict the invention, which should only be limited as defined by the following claims.

What is claimed is:

1. A device comprising:

a one or more flexible filament extending from an enclosure enabled to reflect light;

a blower within said enclosure enabled to produce airflow to alter the shape of said filament;

an armature within said enclosure enabled to produce a rotating motion to alter observed profile of said filament;

a LED array within said enclosure enabled to produce illumination on said filament;

a microcontroller enabled to control two or more of said blower, said armature, and said LED array.

2. The device of claim 1, wherein said armature includes a pivoting rod attached to said filament.

3. The device of claim 1, wherein said LED array comprises:

an array of several light-emitting diodes;

a printed circuit board on which said light-emitting diodes are arranged in a 360-degree circular fashion.

4. The device of claim 1, wherein said microcontroller is enabled to control illumination of said LED array pseudorandomly.

5. The device of claim 1, wherein said microcontroller is enabled to control the velocity and rotational direction of said armature pseudorandomly.

6. The device of claim 1, wherein said microcontroller is further enabled to control the velocity of said blower pseudorandomly.

7. A device comprising:

a one or more flexible filament extending from an enclosure enabled to reflect light;

a blower within said enclosure enabled to produce airflow to alter the shape of said filament;

an armature with integral fan blades within said enclosure enabled to produce a rotating motion using said airflow from said blower to alter observed profile of said filament;

a LED array within said enclosure enabled to produce illumination on said filament;

a microcontroller enabled to control said blower and said LED array.

8. The device of claim 7, wherein said rotating armature comprises a pivoting rod attached to said filament.

9. The device of claim 7, wherein said LED array comprises:

an array of several light-emitting diodes;

a printed circuit board on which said light-emitting diodes are arranged in a 360-degree circular fashion.

10. The device of claim 7, wherein said microcontroller is further enabled to control illumination of said LED array pseudorandomly.

11. The device of claim 7, wherein said microcontroller is further enabled to control the velocity of said blower pseudorandomly.

* * * * *